US005577675A

United States Patent [19]

Ishikawa

[11] Patent Number: 5,577,675

[45] Date of Patent: Nov. 26, 1996

[54] AGITATING PULVERIZER

[75] Inventor: Tsuyoshi Ishikawa, Tochigi, Japan

[73] Assignee: Mitsui Mining Co., Ltd., Tokyo, Japan

[21] Appl. No.: 378,445

[22] Filed: Jan. 25, 1995

[51] Int. Cl.[6] ..... B02C 19/00

[52] U.S. Cl. ..... 241/65; 366/279; 241/172; 241/199.12

[58] Field of Search ..... 366/279; 241/65, 241/172, 199.12

[56] References Cited

U.S. PATENT DOCUMENTS

| | | | |
|---|---|---|---|
| 5,184,783 | 2/1993 | Hockmeyer et al. | 241/172 |
| 5,330,112 | 7/1994 | Nagaoka et al. | 241/172 X |

FOREIGN PATENT DOCUMENTS

| | | | |
|---|---|---|---|
| 1342334 | 9/1963 | France | 241/172 |
| 4-193360 | 7/1992 | Japan | 241/172 |

*Primary Examiner*—Mark Rosenbaum
*Attorney, Agent, or Firm*—Oliff & Berridge

[57] ABSTRACT

An agitating pulverizer which agitates an object and a binder charged into a tank and repeatedly granulates and pulverizes the object, thereby forming particulate matter with a desired particle size. The agitating pulverizer comprises a tank for allowing the object and the binder to be charged thereinto. A low-speed rotating member and a high-speed rotating member are provided at the central bottom portion of the tank and arranged to be rotatable in the directions opposite to each other. A lower agitating member is placed adjacent to the bottom of the tank and interconnected to the low-speed rotating member so as to push the object and the binder upward and also to draw them toward the center of the tank. An upper agitating member is interconnected to the high-speed rotating member and placed farther upward of the lower agitating member so as to push the object and the binder downward and upward, thereby applying shearing force and centrifugal force to the object. The object charged into the tank, together with the binder, is drawn toward the center of the tank while being pushed upward by the lower agitating member. The object is further agitated while being subjected to shearing force and centrifugal force by the upper agitating member, and is repeatedly granulated and pulverized, thereby forming into particulate matter with a suitable particle size.

12 Claims, 6 Drawing Sheets

AGITATING PULVERIZER

BACKGROUND OF THE INVENTION

1. Field of the Invention

The present invention relates to an agitating pulverizer, and more particularly, to an agitating pulverizer which forms particulate matter with a desired particle size by agitating an object together with a binder within a tank by way of agitating vanes and by repeatedly granulating and pulverizing the object.

2. Description of the Related Art

In typical agitating pulverizers, a powder-like object charged into a tank is agitated while a suitable amount of binder is applied to the object and the object is further repeatedly granulated and pulverized, thereby forming the object into particulate matter with a suitable particle size.

Such agitating pulverizers are each provided with a pair of upper and lower agitating vanes which are rotatably provided within the tank. The object is agitated together with a binder while both being subjected to shearing force and centrifugal force and the object is repeatedly granulated and pulverized, thereby forming the object into particulate matter with a desired particle size. The pair of upper and lower agitating vanes are attached to the same rotating shaft and are rotated at the same speed in the same direction. Such a construction gives rise to a disparity of shearing force and centrifugal force between the central portion and the inner wall portion of the tank, which further sometimes causes the object to remain at the central portion of the tank and to adhere to the inner wall.

This makes it difficult to agitate the entire object uniformly, and thus, particulate matter with a uniform particle size cannot be formed.

In order to solve the foregoing problems, an agitating pulverizer constructed as follows has been suggested. A pair of upper and lower agitating vanes are rotatably provided within the tank, and the vanes are interconnected to the respective shafts which are rotated in different directions. Accordingly, the lower agitating vane is rotated at lower speed, while the upper vane is rotated at higher speed.

In the agitating pulverizer as described above, the object within the tank is drawn toward the center of the tank while being pushed upward by the lower vane which is rotated at lower speed, and consequently, a mountain-like object is formed near the leading portions in the rotating direction of the vanes.

The thus-obtained mountain-like object is subjected to shearing force while being pushed downward by the upper agitating vane which is rotated at higher speed. It is then agitated together with the binder charged into the tank and is repeatedly granulated and pulverized, thereby forming the object into particulate matter with a desired particle size.

However, the lower agitating vane is formed in such a way that the portion facing the bottom of the tank has a larger area, which increases resistance during the agitation of the object. Hence, the object is more likely to adhere to the bottom of the tank, thereby increasing power consumption.

Such an agitating pulverizer also presents the following problem. The agitating vanes only have a small force for pushing the object upward because of the configuration, which makes it difficult to agitate the entire object uniformly,-thereby failing to form particulate matter with a uniform particle size.

An agitating pulverizer which prevents an object from adhering to the bottom and the inner wall of a tank is disclosed in Japanese Patent Publication No. 59-21649.

In such an agitating pulverizer, an agitating vane is provided adjacent to the bottom of the tank, and a crushing vane is also provided within the tank farther upward of the agitating vane. The agitating vane and the crushing vane are interconnected to different rotating shafts so as to be rotatable in the same direction.

In the agitating pulverizer described above, the object charged into the tank is drawn toward the center of the tank by the projections provided at the outward ends of the agitating vane while being pushed upward by the rotation of the agitating vane at lower speed, thereby forming a mountain-like object at the leading portions in the rotating direction of the agitating vane.

The thus-obtained mountain-like object is pulverized while being subjected to shearing force by the rotation of the crushing vane at higher speed. The object is agitated together with the binder charged into the tank and is repeatedly granulated and pulverized, thereby forming the object into particulate matter with a desired particle size.

However, the agitating pulverizer as described above is constructed in such a way that the rotation center of a drive source for the agitating vane is placed substantially linearly with both outward ends of the agitating vane. This increases the load during the rotation, and thus, the object is likely to adhere to the bottom of the tank, and the force for pushing the object upward is decreased.

Hence, even though the crushing vane is rotated at higher speed, the entire object cannot be agitated uniformly, thereby failing to form particulate matter with a uniform particle size.

Additionally, if it is desired that a large tank for charging an object and a binder thereinto be employed, it requires a large amount of time and effort to assemble and dissemble the tank, and also it is extremely troublesome to perform maintenance, such as repairing and exchanging the agitating vane.

SUMMARY OF THE INVENTION

Accordingly, an object of the present invention is to provide an agitating pulverizer which can agitate an object only with a small drive force and prevents the object from adhering to the bottom and the inner wall of the tank.

Another object of the present invention is to provide an agitating pulverizer which can agitate an object only with a small drive force and prevents the object from adhering to the bottom and inner wall of the tank, and which also agitates the entire object uniformly, thereby forming the object into particulate matter with a uniform particle size.

A further object of the present invention is to provide an agitating pulverizer which can agitate an object only with a small drive force and prevents the object from adhering to the bottom and inner wall of the tank, and which also agitates the entire object uniformly, thereby forming the object into particulate matter with a uniform particle size, the agitating pulverizer further allowing easy maintenance even for a larger tank.

These and other objects, features and advantages of this invention will become clear from the following description of the preferred embodiments when the same is read in conjunction with the accompanying drawings.

DESCRIPTION OF THE PREFERRED EMBODIMENTS

Figure 1:
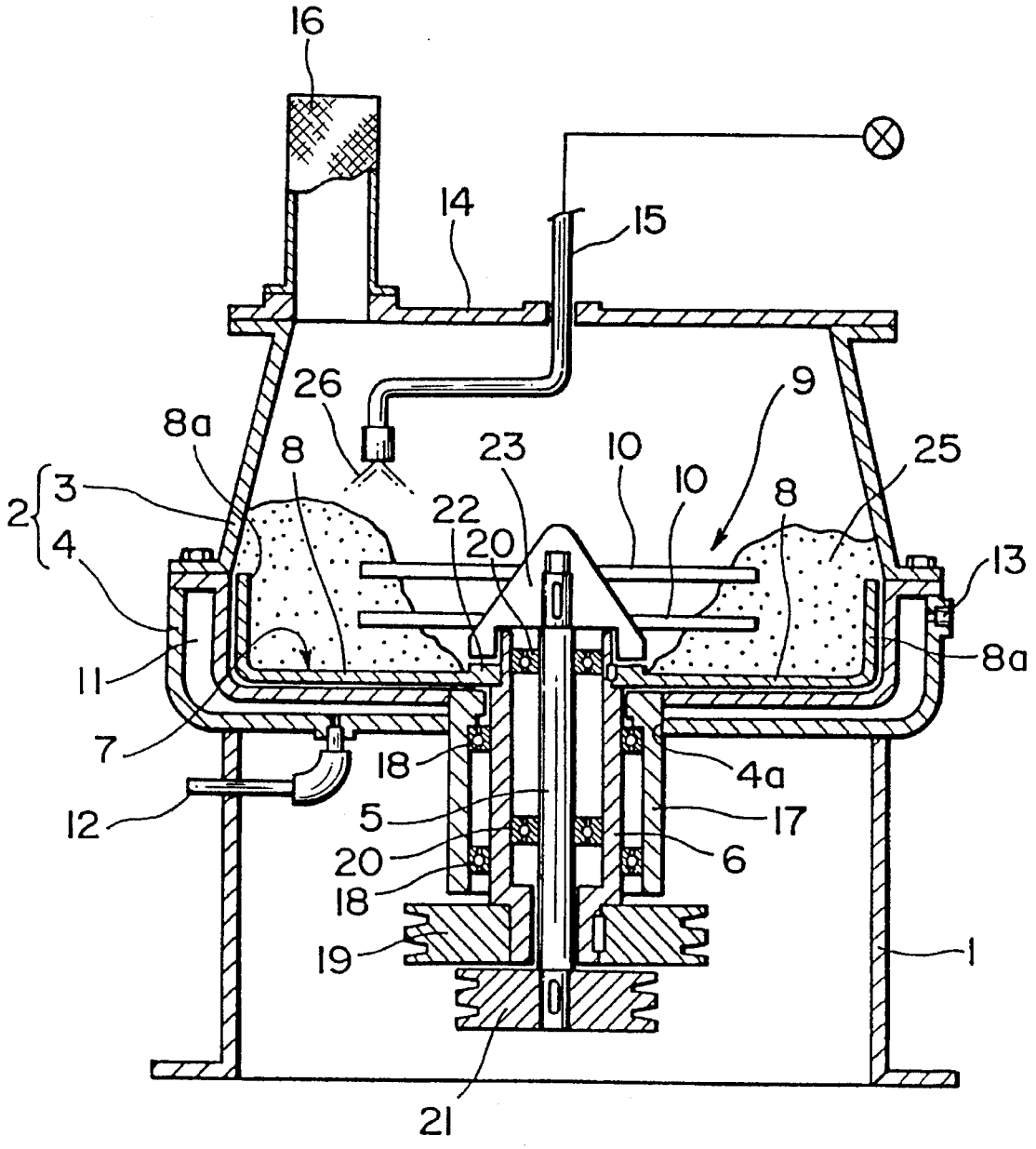
FIG. 1 is a longitudinal sectional view of a first embodiment of an agitating pulverizer according to the present invention.
Figure 2:
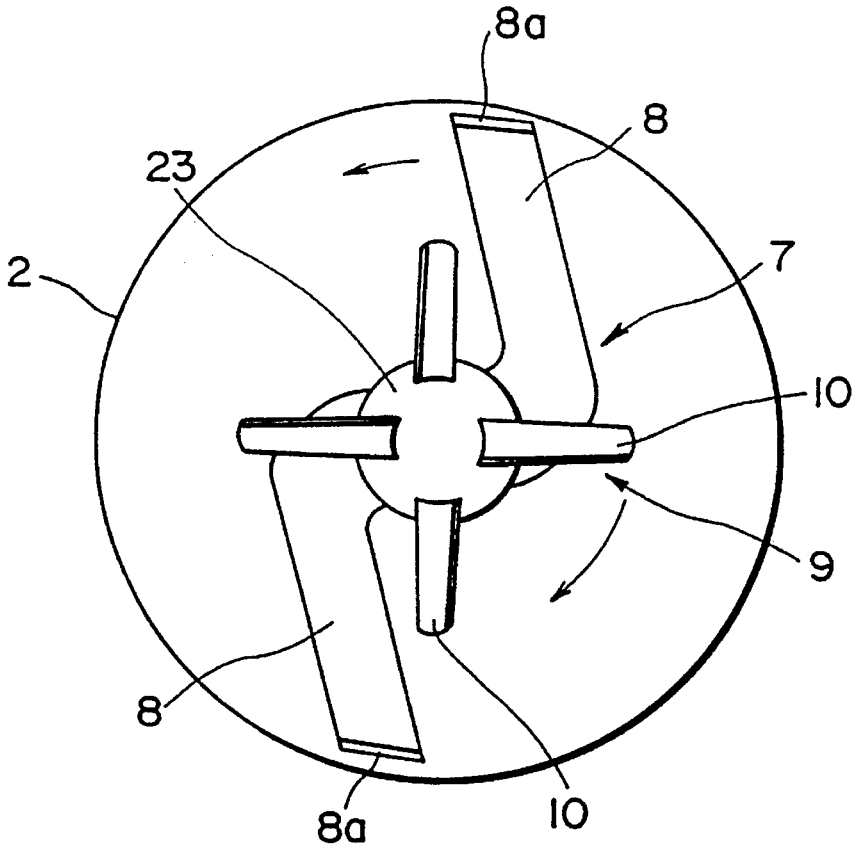
FIG. 2 illustrates the positional relationship between the upper agitating member and the lower agitating member shown in FIG. 1.
Figure 3:
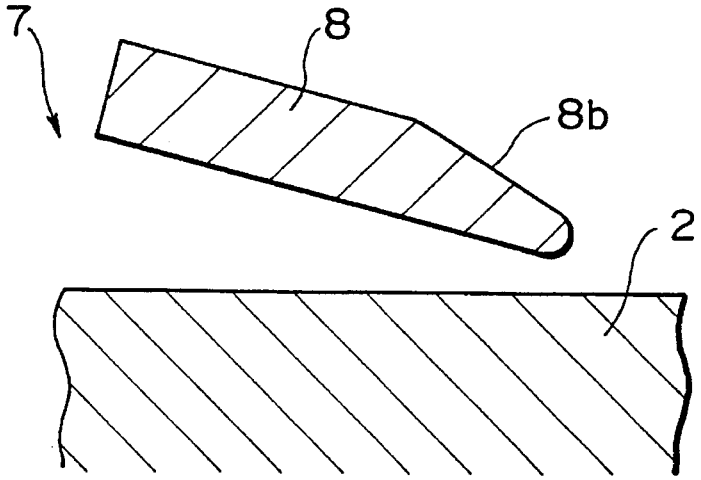
FIG. 3 is a sectional view illustrative of the relationship between the lower agitating member shown in FIG. 1 and the bottom of the tank.

FIGS. 1–3 illustrate a first embodiment of an agitating pulverizer according to the present invention.

The agitating pulverizer shown in this embodiment has a tank 2 which is formed of a bowl-like lower tank portion 4 with the opened top and a truncated cone-like upper tank portion 3 which is fixed to the top opening of the lower tank portion 4 by way of a bolt.

Arranged at the center bottom of the lower tank portion 4 are: a high-speed rotating shaft 5 which is a high-speed rotating member and which is coaxial with and rotatably attached to the tank 2; and a low-speed rotating shaft 6 which is a low-speed rotating member. Also, a lower agitating member 7 is arranged at the bottom of the tank 2 so as to be interconnected to the low-speed rotating shaft 6. An upper agitating member 9 is also arranged within the tank 2 more further upward of the lower agitating member 7 so as to be interconnected to the high-speed rotating member 5.

The tank 2 is fixed to the top of a base 1 by such means of welding, or the like. The lower tank portion 4 of the tank 2 is double-walled to form a jacket 11 between the walls, thereby allowing gases and liquids to flow in the jacket 11.

The temperatures of the gases and liquids flowing within the jacket 11 are adjusted so that the tank 2 is cooled or heated to be set at a predetermined temperature.

A supply nozzle 12 is arranged to supply gases or liquids to the inside of the jacket 11, while a discharge nozzle 13 is provided to discharge the gases or liquids from the jacket 11.

A disk-like lid 14 is provided to close the top opening of the upper tank portion 3 of the tank 2.

Provided at a suitable position of the lid 14 are a charging nozzle 15 for charging a binder 26 into the tank 2 and a ventilation filter 16 through which gases within the tank 2 are allowed to vent.

A vertical through-hole 4*a* is provided at the center of the lower tank portion 4, and the top end of a cylindrical bearing case 17 placed inside the base 1 is inserted into the through-hole 4*a* in such a way that the top end surface of the bearing case 17 matches the bottom surface of the lower tank portion 4.

A pair of upper and lower bearings 18, 18 are attached to the inside of the bearing case 17, and the cylindrical low-speed rotating shaft 6 is rotatably supported by the bearings 18, 18.

The top end of the low-speed rotating shaft 6 projects into the tank 2 so that the lower agitating member 7 can be attached to the top end of the rotating shaft 6. On the other hand, the bottom end of the low-speed rotating shaft 6 projects downward of the bearing case 17 so that a drive pulley 19 can be attached to the bottom end of the low-speed rotating shaft 6.

A pair of upper and lower bearings 20, 20 are attached to the inner surface of the low-speed rotating shaft 6, and the bar-like high speed rotating shaft 5 is rotatably supported by the bearings 20, 20.

The top end of the high-speed rotating shaft 5 projects more further upward than that of the low-speed rotating shaft 6 so that the upper agitating member 9 is attached to the top end of the high-speed rotating shaft 5. On the other hand, the bottom end of the high-speed rotating shaft 5 projects more further downward than that of the low-speed rotating shaft 6 so that a drive pulley 21 can be attached to the bottom end of the high-speed rotating shaft 5.

The drive pulley 21 for the high-speed rotating shaft 5 is interconnected to a high-speed drive source (not shown) by way of a V-belt (not shown). The drive pulley 19 for the low-speed rotating shaft 6 is interconnected to a low-speed drive source (not shown) by way of a V-belt (not shown). The high-speed and low-speed rotating shafts 5 and 6 are reversibly rotatable to each other by such means as reversibly rotating the respective drive sources.

The lower agitating member 7 is formed by fixing two flat-like agitating vanes 8, 8 around the peripheral surface of a cylindrical boss 22 so as to opposedly face to each other. The agitating vanes 8, 8 are each interconnected at one end to the peripheral surface of the boss 22 and are each raised at the other end at a predetermined height along the inner wall of the tank 2 so that a predetermined clearance can be formed between the bottom surface and the inner wall of the tank 2.

Projections 8*a*, 8*a* are formed at the raised ends of the vanes 8, 8 so as to draw an object 25 toward the center of the tank 2.

One end of each of the vanes 8, 8 is placed farther behind in the rotating direction than the line connecting between the other end of each of the vanes 8, 8 and the center of the boss 22 (See FIG. 2).

The upper agitating member 9 is formed of two vertical stages of agitating vanes 10, 10, 10, 10 (two at each of upper and lower stages and four in total) which are attached to the peripheral surface of a cone-like base boss 23.

The agitating vanes 10, 10 at the lower stage are tilted at a predetermined angle so that the leading ends of the vanes 10, 10 in the rotating direction can be arranged more upward than the trailing ends of the vanes 10, 10.

On the other hand, the agitating vanes 10, 10 at the upper stage are tilted at a predetermined angle so that the leading ends of the vanes 10, 10 in the rotating direction can be arranged more downward than the trailing ends.

The vanes 10, 10 at the lower stage and the vanes 10, 10 at the upper stage are attached to the peripheral surface of the boss 23 so that they can cross at right angles with each other as viewed from the top. Each vane 10 of the upper agitating member 9 is sized approximately half of the length of each vane 8 of the lower agitating member 7.

The operation of the foregoing components will now be explained.

The lid 14 is first opened to charge a predetermined amount of powder-like object 25 into the tank 2. The lid 14 is then closed to seal the opening of the tank 2. Subsequently, the high-speed drive source (not shown) and the low-speed drive source (not shown) are driven.

Then, the low-speed rotating shaft 6 and the high-speed rotating shaft 5 are rotated by way of the V-belts (not shown) and the drive pulleys 19 and 21 so as to allow the lower agitating member 7 to rotate at low speed and the upper agitating member 9 to rotate at high speed. Simultaneously, a suitable amount of binder 26 is charged into the tank 2 from the charging nozzle 15.

The object 25 placed at the bottom of the tank 2 is pushed upward by the vanes 8, 8 of the lower agitating member 7 and is also drawn toward the center of the tank 2 by the projections 8*a*, 8*a* arranged at the raised ends of the vanes 8, 8. In consequence, the object 25 is accumulated to form a mountain-like shape near the leading ends of the vanes 8, 8 in the rotating direction.

Shearing force and centrifugal force are applied to the thus-obtained mountain-like object 25 by the vanes 10, 10, 10, 10 of the upper agitating member 9 which rotates at high speed so as to be scattered toward the inner wall of the tank 2.

The object 25 is then again drawn toward the center of the tank 2 while being pushed upward by the vanes 8, 8 of the lower agitating member 7. The foregoing procedure is repeated so that the object 25 is agitated together with the binder 26 charged from the charging nozzle 15 and is further repeatedly granulated and pulverized, thereby forming the object 25 into particulate matter with a desired particle size.

As is seen from the foregoing description, the agitating pulverizer of this embodiment constructed as described above is particularly formed as follows.

One end of each of the vanes 8, 8 of the lower agitating member 7 is formed to be placed farther behind in the rotating direction than the line interconnecting between the other end of each of the vanes 8, 8 and the center of the boss 22. Further, the other end of each of the vanes 8, 8 is raised, and the projection 8*a* is formed at the raised portion so as to draw the object 25 toward the center of the tank 2.

Moreover, the vanes 10, 10, 10, 10 of the upper agitating member 9 are arranged so that leading ends of the vanes 10 in the rotating direction are tilted upward or downward at a predetermined angle.

The agitating pulverizer of the first embodiment is formed as described above. Thus, even though there arises a disparity of shearing force and centrifugal force between the central portion and the inner wall portion of the tank 2, and accordingly, even though the object 25 adheres to the inner wall of the tank 2, it is drawn toward the center of the tank 2 while being pulverized by the projections 8*a*, 8*a* of the vanes 8, 8 of the lower agitating member 7, and shearing force and centrifugal force are applied to the object 25 by the vanes 10, 10, 10, 10 of the upper agitating member 9 which rotates at high speed.

As a consequence, a small drive force is sufficient to agitate the object 25, which can also be prevented from being settled at the bottom and the inner wall of the tank 2, so that the object 25 can be uniformly agitated, thereby forming particulate matter with a uniform particle size.

Figure 4:
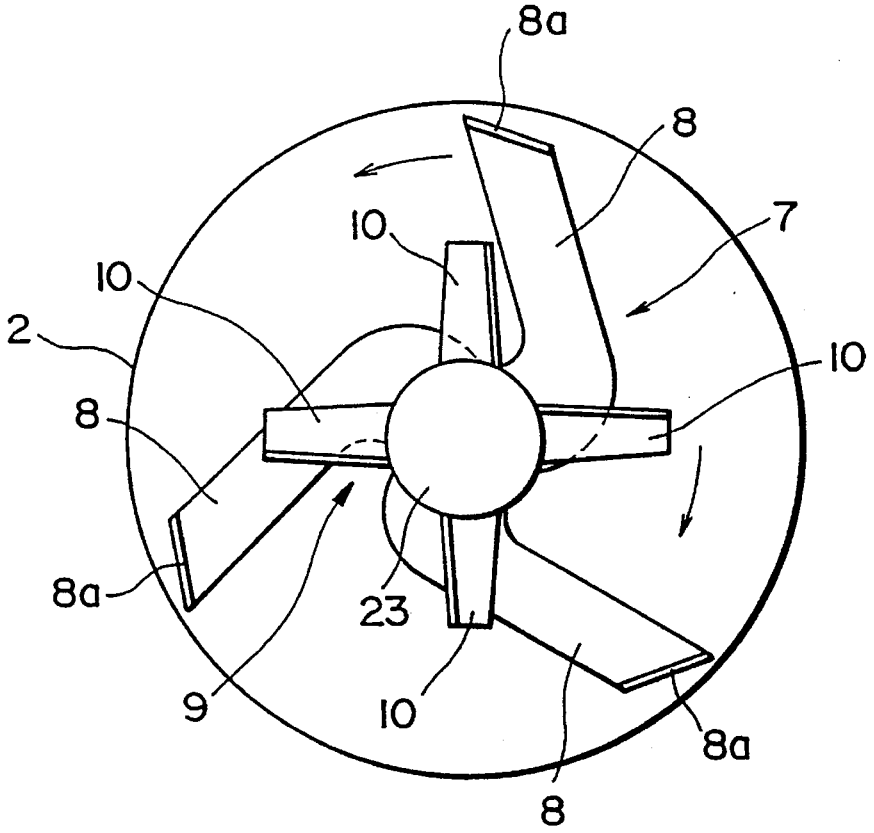
FIG. 4 illustrates another example of the lower agitating member shown in FIG. 1.

Although in this embodiment two vanes 8, 8 of the lower agitating member 7 are provided, this is not exclusive, and three or more vanes 8 may be provided (See FIG. 4).

Also, although in this embodiment the four vanes 10, 10, 10, 10 (two for each of the upper and lower stages) are provided, this is not exclusive, and more than two vanes 10 may be arranged at each of a plurality of stages.

Figure 6:
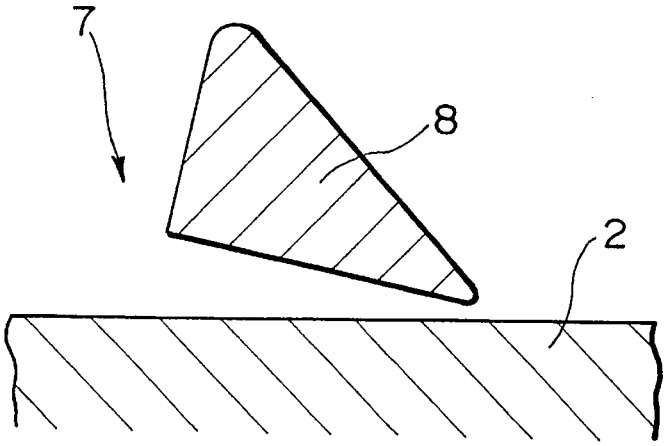
FIG. 6 is a sectional view illustrative of the relationship between the lower agitating member shown in FIG. 5 and the bottom of the tank.

Each of the vanes 8, 8, 8 of the lower agitating member 7 is arranged in such a way that the top surface of the leading end in the rotating direction is formed to be a tapered surface 8*b*, as illustrated in FIG. 3. However, as illustrated in FIG. 6, each of the vanes 8, 8, 8 may be formed to be triangular in cross section and may become thicker as it goes toward its trailing end in the rotating direction. Each of the vanes 8, 8, 8 may be further formed in such a way that the portion facing the bottom of the tank 2 has a smaller area, and the further toward the trailing end a location is on the vanes 8, 8, 8, the farther it is apart from the bottom of the tank 2.

Figure 5:
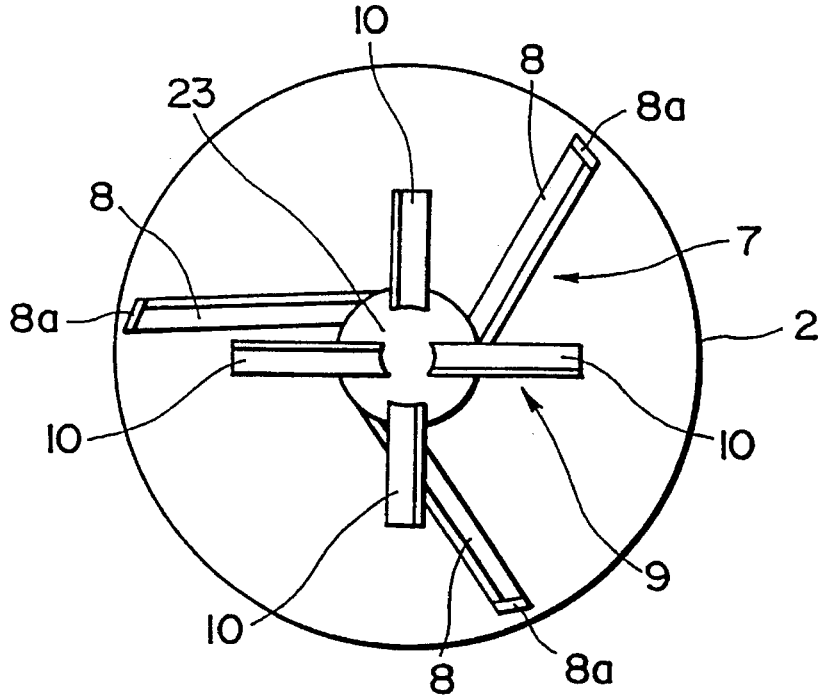
FIG. 5 illustrates the essential portion of a second embodiment of an agitating pulverizer according to the present invention.

FIGS. 5 and 6 illustrate a second embodiment of the agitating pulverizer of the present invention. The agitating pulverizer shown in this embodiment is constructed in such a way that the number of the vanes 8 of the lower agitating member 7 is three and the leading ends of the vanes 8, 8, 8 are tilted downward at a predetermined angle.

Further, the vanes 8, 8, 8 of the lower agitating member 7 are formed to be triangular in cross section, and the vanes 8, 8, 8 become thicker towards their trailing ends in the rotating direction. The vanes 8, 8, 8 are also each formed in such a way that the portion facing the tank 2 has a smaller area, and the farther toward their trailing ends a location is on each of the vanes 8, 8, 8, the farther it is apart from the bottom of the tank 2 (See FIG. 6).

The other constructions than the ones described above are similar to those shown in the first embodiment, and a detailed explanation will thus be omitted.

The agitating pulverizer shown in this embodiment is also constructed as follows. The outward ends of the vanes 8, 8, 8 of the lower agitating member 7 are raised, and the projections 8*a*, 8*a*, 8*a* are formed at the raised portions so as to draw the object 25 toward the center of the tank 2. The vanes 10, 10, 10, 10 of the upper agitating member 9 are arranged in such a way that the leading ends in the rotating direction are tilted upward or downward at a predetermined angle. Thus, the second embodiment also exhibits advantages similar to those obtained in the first embodiment.

Namely, even though there arises a disparity of shearing force and centrifugal force between the central portion and the inner wall portion of the tank 2, the object 25 adhering to the inner wall of the tank 2 is drawn toward the center of the tank 2 while being pulverized by the projections 8*a*, 8*a*, 8*a* of the vanes 8, 8, 8 of the lower agitating member 7, and shearing force and centrifugal force are applied to the object 25 by the vanes 10, 10, 10, 10 of the upper agitating member 9 which rotates at high speed.

This can prevent the object 25 from being settled at the inner wall of the tank 2 so that the object 25 can be uniformly agitated, thereby obtaining particulate matter with a uniform particle size.

Additionally, as illustrated in FIG. 6, the vanes 8, 8, 8 of the lower agitating member 7 are arranged in such a way that the leading ends in the rotating direction are tilted downward. The vanes 8, 8, 8 are also formed to be triangular in cross section in such a way that the vanes 8, 8, 8, become thicker towards their trailing ends in the rotating direction. They are further each formed as follows. The portion facing the bottom of the tank 2 has a smaller area, and the farther toward the trailing ends a location is on the vanes 8, 8, 8, the farther it is apart from the bottom of the tank 2.

This construction enables the object 25 placed at the bottom of the tank 2 to be efficiently pushed upward, thereby decreasing resistance at the bottom of the tank 2. This further prevents the object 25 from being settled at the bottom of the tank 2, thereby enabling a remarkable decrease in power consumption.

In this embodiment, the three vanes 8 of the lower agitating member 7 are arranged, and the four vanes 10 of the upper agitating member 10 are provided at the upper and lower stages (two at each stage). However, this is not exclusive. For example the number of vanes 8 of the lower agitating member 7 may be two or more than three, and more than two vanes 10 of the upper agitating member may be arranged at each of a plurality of stages.

Further, the vanes 8, 8, 8 of the lower agitating member 7 may be formed as shown in FIG. 3.

Figure 7:
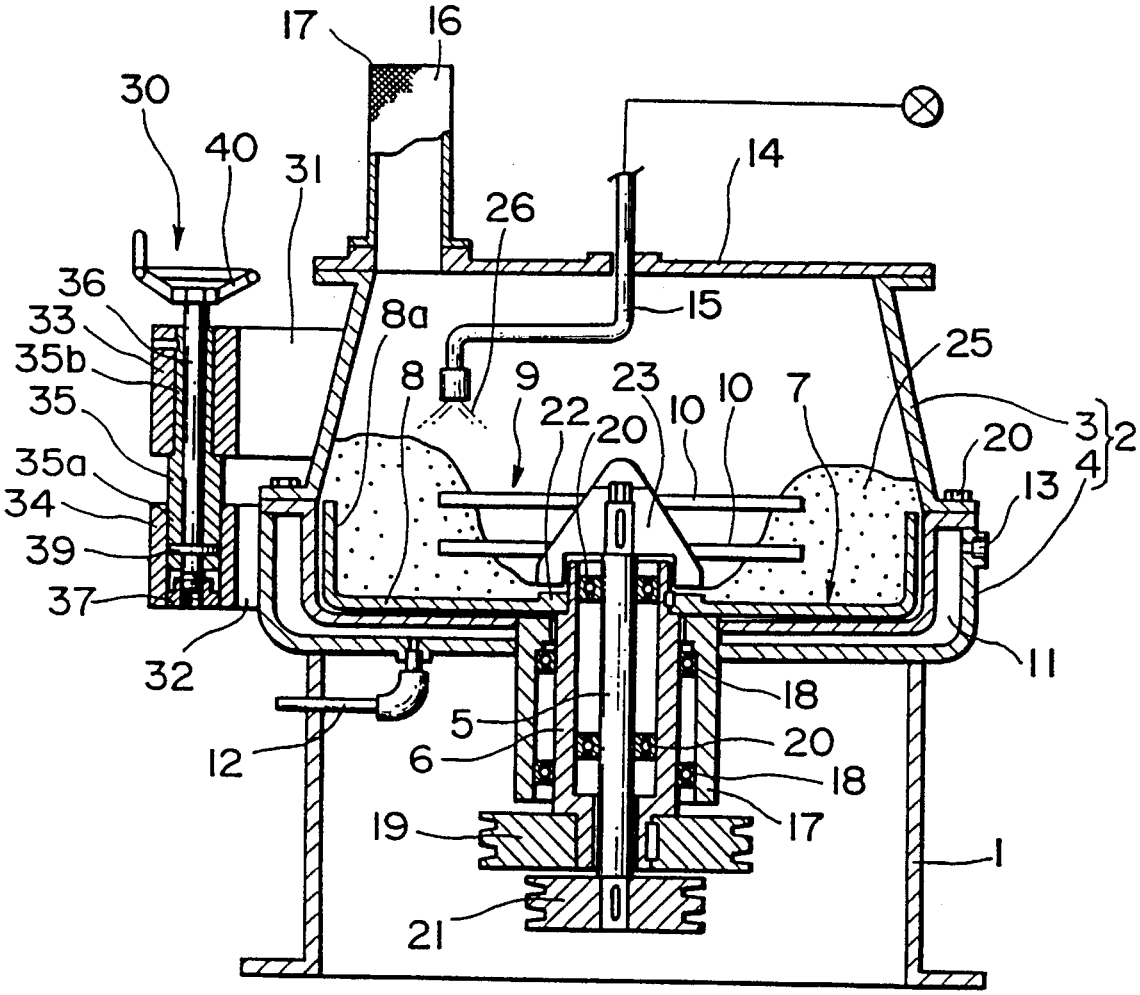
FIG. 7 is a longitudinal sectional view illustrative of a third embodiment of an agitating pulverizer according to the present invention.
Figure 8:
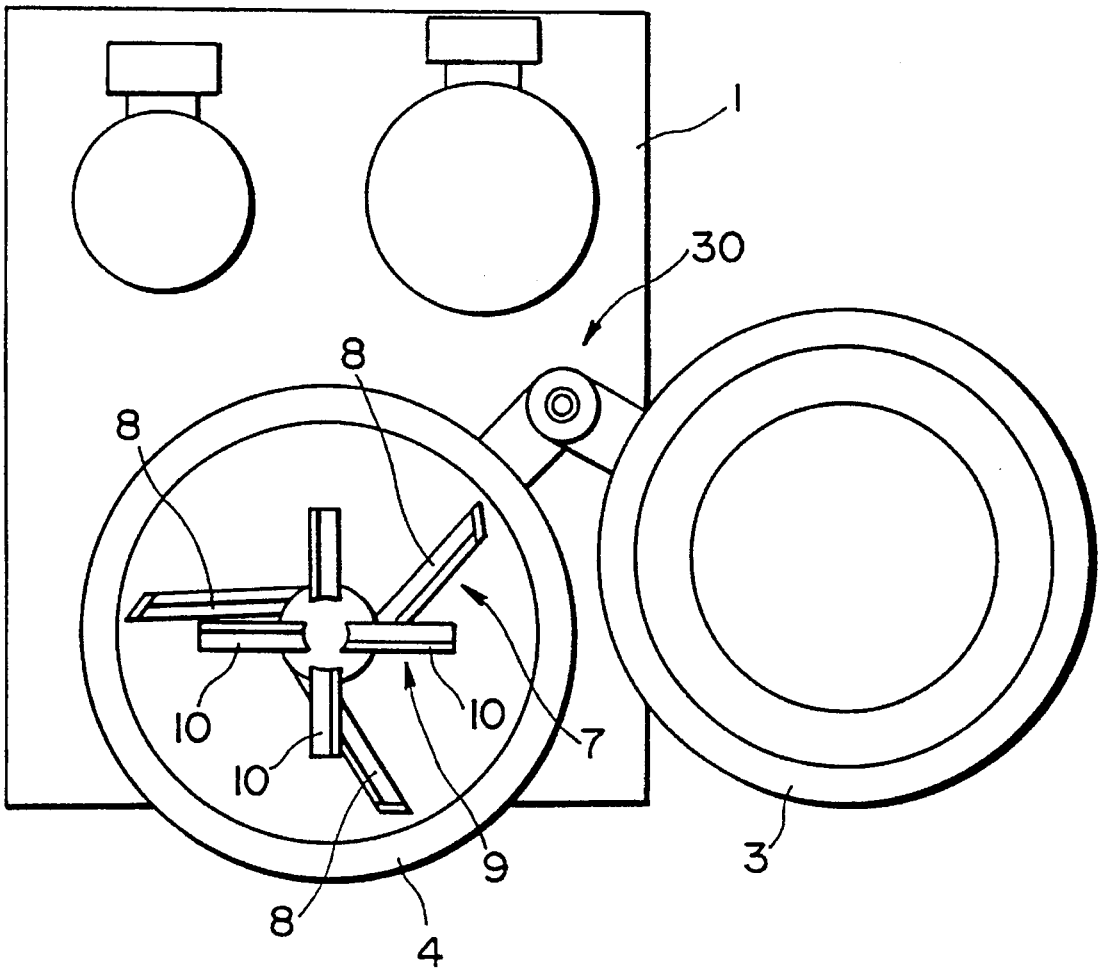
FIG. 8 illustrates the relationship between the upper tank portion and the lower tank portion shown in FIG. 7.
Figure 9:
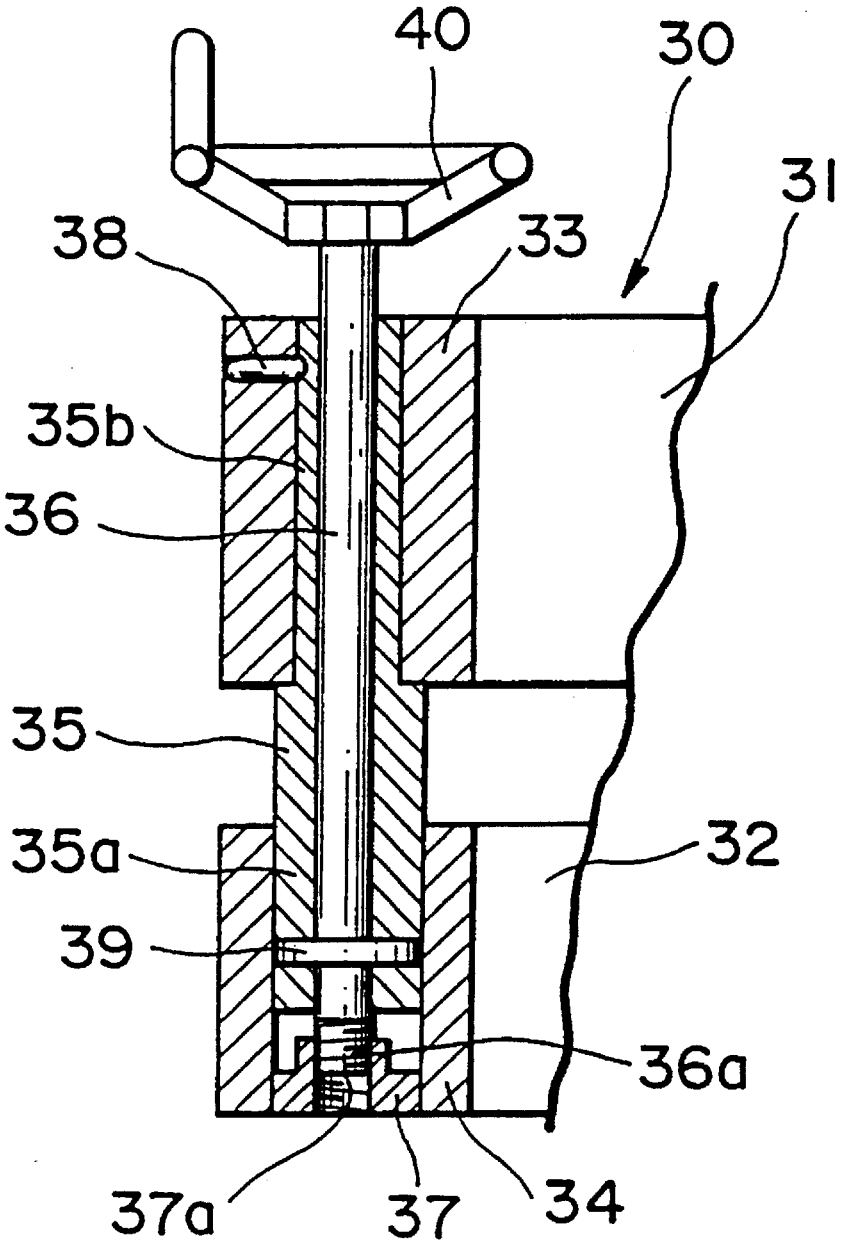
FIG. 9 is a sectional view illustrative of detaching means shown in FIGS. 7 and 8.

FIGS. 7–9 illustrate a third embodiment of the agitating pulverizer of the present invention. The agitating pulverizer shown in this embodiment is constructed in such a way that a detaching means 30 for moving an upper tank portion 3 is arranged between the upper tank portion 3 and a lower tank portion 4 so that the upper tank portion 3 can be detachable from the lower tank portion 4. The other constructions are similar to those of the second embodiment, and a detailed explanation thereof will thus be omitted.

The detaching means 30 comprises: plate-like arms 31 and 32 provided for the upper and lower tank portions 3 and 4, respectively; tube-like upper and lower bosses 33 and 34 arranged in such a way that the axes of the bosses 33 and 34 coincide with the forward ends of the arms 31 and 32, respectively; and a tube-like support member 35 inserted between the bosses 33 and 34; and a shaft 36.

The support member 35 is formed of an enlarged portion 35*a* and a smaller portion 35*b*. The enlarged portion 35*a* is fit into the center of the lower boss 34, while the smaller portion 35*b* is fit into the center of the upper boss 33.

The enlarged portion 35*a* is vertically movable and rotatably fit into the center of the lower boss 34, while the smaller portion 35*b* is fit into the upper boss 33 and is then integrally fixed to the upper boss 33 by way of a pin 38.

The shaft 36 is rotatably inserted into the center of the support member 35 and is prevented from coming off from the support member 35 by way of a ring 39 attached to the support member 35.

A screw 36*a* is provided for the bottom end of the shaft 36 and is threadably engaged with another screw 37*a* placed at the center of a base 37 provided at the bottom end of the lower boss 34. The upper end of the shaft 36 projects farther upward than that of the upper boss 33, and a handle 40 is attached to the projecting portion of the shaft 36.

For separating the upper tank portion 3 from the lower tank portion 4, a bolt by which the upper tank portion 3 is fixed to the lower tank portion 4 is removed, and the handle 40 of the detaching means 30 is turned in a desired direction so as to vary the position of the screw 36*a* of the shaft 36 in relation to the screw 37*a* of the base 37, thereby separating the upper tank portion 3 from the lower tank portion 4 at a predetermined dimension. In such a state, the upper tank portion 3 is turned so as to be easily separated from the lower tank portion 4.

The agitating pulverizer of this embodiment constructed as described above also exhibits advantages similar to those obtained in the second embodiment.

The outward ends of the vanes 8, 8, 8 of the lower agitating member 7 are raised, and the projections 8*a*, 8*a*, 8*a* are formed at the raised portions so as to draw the object 25 toward the center of the tank 2. Further, the leading ends in the rotating direction of the vanes 10, 10, 10 of the upper agitating member 9 are tilted upward or downward at a predetermined angle.

Thus, even though there arises a disparity of shearing force and centrifugal force between the central portion and the inner wall portion of the tank 2, the object 25 adhering to the inner wall of the tank 2 is drawn toward the center of the tank 2 while being pulverized by the projections 8*a*, 8*a*, 8*a* provided for the vanes 8, 8, 8 of the lower agitating member 7, and shearing force and centrifugal force are applied to the object 25 by the vanes 10, 10, 10, 10 of the upper agitating member 9 which rotates at high speed.

This can prevent the object 25 from being settled at the inner wall of the tank 2 so that the object 25 can be uniformly agitated, thereby obtaining particulate matter with a uniform particle size.

Additionally, the vanes 8, 8, 8 of the lower agitating member 7 are arranged in such a way that the leading ends in the rotating direction are tilted downward. The vanes 8, 8, 8 are further formed to be triangular in cross section in such a way that they become thicker toward their trailing ends in the rotating direction. The portions of the vanes 8, 8, 8 facing the bottom of the tank 2 each have a smaller area, and the farther toward the trailing ends a location is on the vanes 8, 8, 8, the farther it is apart from the bottom of the tank 2.

This construction enables the object 25 placed at the bottom of the tank 2 to be efficiently pushed upward, thereby decreasing resistance at the bottom of the tank 2. This further prevents the object 25 from being settled at the bottom of the tank 2, thereby enabling a remarkable decrease in power consumption.

Moreover, the agitating pulverizer shown in this embodiment is particularly characterized in that the upper tank portion 3 is detachable from the lower tank portion 4, and the detaching means 30 is also provided to attach and detach the upper tank portion 3 to/from the lower tank portion 4.

For separating the upper tank portion 3 from the lower tank portion 4, the handle 40 of the detaching means 30 is turned to lift the upper tank portion 3 and to separate it from the lower tank portion 4. In such a state, the upper tank portion 3 is turned so as to easily separate from the lower tank portion 4. For assembling the upper tank portion 3 and the lower tank portion 4, the foregoing procedure is simply reversed.

This remarkably simplifies maintenance, such as repairing and assembling the vanes 8 and 10 of the respective agitating members 7 and 9.

In the foregoing embodiments, the vanes 8 and 10 of the respective lower and upper agitating members 7 and 9 are formed to be flat. However, the outward ends of the vanes 8 and 10 may be twisted in the leading or trailing rotating direction, and the farther toward outward a location is on the leading ends of the vanes 8 and 10, the more sharply it may be tilted. Hence, such a variation in the tilting angle of the agitating vanes 8 and 10 further enhances the effect of drawing the object 25 toward the center of the tank 2.

As described above, the object charged into the tank is drawn toward the center of the tank by the projections of the vanes of the lower agitating member while being pushed upward by the vanes, thereby forming a mountain-like object adjacent to the leading ends in the rotating direction of the agitating vanes.

Shearing force and centrifugal force are applied to the thus-formed mountain-like object by the vanes of the upper agitating member which rotates at high speed so that the object is scattered toward the inner wall of the tank.

The foregoing procedure is repeated so that the object is agitated together with the binder and is further repeatedly granulated and pulverized, thereby forming the object into particulate matter with a desired particle size.

Accordingly, even though there arises a disparity of shearing force and centrifugal force between the central portion and the inner wall portion of the tank, which causes the object to adhere to the inner wall of the tank, the object can be pulverized by the projections of the vanes of the lower agitating member. This can prevent the object from being settled at the inner surface of the tank so that the entire object can be uniformly agitated, thereby obtaining particulate matter with a desired particle size.

Moreover, the leading ends in the rotating direction of the vanes of the lower agitating member are tilted downward at a predetermined angle. The leading ends of the vanes of the upper agitating member are also tilted toward the leading ends or the trailing ends at a predetermined angle, thereby further increasing a force for pushing the object upward and enhancing the efficiency of agitating the object.

Additionally, the vanes of the upper agitating member are provided at each of a plurality of stages, thereby enhancing the efficiency of agitating the object. Also, the farther outward a location is on the leading ends in the rotating direction of the vanes of the upper and lower agitating members, the more sharply it is tilted, thereby further improving the agitation efficiency.

Still further, the detaching means for separating the upper tank portion from the lower tank portion is provided between the upper and lower tank portions, thereby remarkably simplifying maintenance, such as repairing and exchanging the vanes of the respective agitating members within the tank.

What is claimed is:

1. An agitating pulverizer which agitates an object and a binder charged into a tank and repeatedly granulates and pulverizes the object, thereby forming particulate matter with a desired particle size, said agitating pulverizer comprising:

a tank including a bottom having a central portion and an inner surface for allowing the object and the binder to be charged thereinto;

a low-speed rotating member and a high-speed rotating member provided at the central bottom portion of said tank and arranged to be rotatable in directions opposite to each other;

a lower agitating member placed adjacent to the bottom of said tank and interconnected to said low-speed rotating member so as to push the object and the binder upward and also to draw them toward the center of said tank; and an upper agitating member interconnected to said high-speed rotating member and placed farther upward of said lower agitating member so as to push the object and the binder downward and upward, thereby applying shearing force and centrifugal force to the object;

said lower and upper agitating members allowing the object to be formed into particulate matter with a desired particle size wherein said lower agitating member is formed of at least two agitating vanes that are each interconnected at one end to said low-speed rotating member, and said one end is placed farther behind in the rotating direction than a line connecting between the center of said low-speed rotating member and an other end of each of said agitating vanes.

2. An agitating pulverizer according to claim 1, wherein said lower agitating member is constructed so that the other end of each of said agitating vanes is raised along the inner surface of said tank.

3. An agitating pulverizer according to claim 1, wherein said upper agitating member includes at least one upper and lower stage and is formed of at least two agitating vanes including leading portions provided at each of the upper and lower stages, and the vanes at the upper stage are arranged to be tilted so that the leading portions in the rotating direction are farther upward, while the vanes at the lower stage are arranged to be tilted so that the leading portions in the rotating direction are farther downward.

4. An agitating pulverizer according to claim 1, wherein said tank comprises: a jacket for cooling and heating the inside of said tank; a charging nozzle for charging the binder therethrough; and a ventilation filter for allowing a gas within said tank to vent.

5. An agitating pulverizer according to claim 1, wherein said tank comprises a truncated cone-like upper tank portion and a bowl-like lower tank portion, both of said tank portions being detachable, and detaching means for attaching and detaching said upper and lower tank portions is provided in the vicinity of said tank.

6. An agitating pulverizer which agitates an object and a binder charged into a tank and repeatedly granulates and pulverizes the object, thereby forming particulate matter with a desired particle size, said agitating pulverizer comprising:

a tank including a bottom having a central portion and an inner surface for allowing the object and the binder to be charged thereinto, said tank including a truncated cone-like upper tank portion and a bowl-like lower tank portion which is detachable from said upper tank portion;

detaching means arranged in the vicinity of said tank so as to separate said upper tank portion from said lower tank portion;

a low-speed rotating member and a high-speed rotating member provided at the central bottom portion of said tank and arranged to be rotatable in directions opposite to each other;

a lower agitating member placed adjacent to the bottom of said tank and interconnected to said low-speed rotating member so as to push the object and the binder upward and also to draw them toward the center of said tank; and an upper agitating member interconnected to said high-speed rotating member and placed farther upward of said lower agitating member so as to push the object and the binder downward and upward, thereby applying shearing force and centrifugal force to the object;

said lower and upper agitating members allowing the object to be formed into particulate matter with a desired particle size, wherein said lower agitating member is formed of at least two agitating vanes that are each interconnected at one end to said low-speed rotating member, and said one end is placed farther behind in the rotating direction than a line connecting between the center of said low-speed rotating member and an other end of each of said agitating vanes.

7. An agitating pulverizer according to claim 6, wherein said lower agitating member is constructed so that the other end of each of said agitating vanes is raised along the inner surface of said tank.

8. An agitating pulverizer according to claim 6, wherein said upper agitating member includes at least an upper and lower stage and is formed of at least two agitating vanes including leading portions provided at each of the upper and lower stages, and the vanes at the upper stage are arranged to be tilted so that the leading portions in the rotating direction are farther upward, while the vanes at the lower stage are arranged to be tilted so that the leading portions in the rotating direction are farther downward.

9. An agitating pulverizer according to claim 6, wherein said tank comprises: a jacket for cooling and heating the inside of said tank; a charging nozzle for charging the binder therethrough; and a ventilation filter for allowing a gas within said tank to vent.

10. An agitating pulverizer which agitates an object and a binder charged into a tank and repeatedly granulates and pulverizes the object, thereby forming particulate matter with a desired particle size, said agitating pulverizer comprising:

a tank including a bottom having a central portion and an inner surface for allowing the object and the binder to be charged thereinto, said tank including a truncated cone-like upper tank portion and a bowl-like lower tank portion which is detachable from said upper tank portion;

detaching means arranged in the vicinity of said tank so as to separate said upper tank portion from said lower tank portion;

a low-speed rotating member and a high-speed rotating member provided at the central bottom portion of said tank and arranged to be rotatable in directions opposite to each other;

a lower agitating member placed adjacent to the bottom of said tank and being formed of at least two agitating vanes including two ends, one end of each of said vanes being placed farther behind in the rotating direction than a line connecting between the center of said low-speed rotating member and the other end of each of said vanes of said lower agitating member, said lower agitating member pushing the object and the binder within said tank upward and also drawing them toward the center of said tank; and an upper agitating member, including at least an upper and lower stage interconnected to said high-speed rotating member and placed farther upward of said lower agitating member, said upper agitating member being formed of at least two agitating vanes including leading portions at each of the upper and lower two stages in which the vanes at the upper stage are arranged to be tilted so that the leading portions in the rotating direction are farther upward, while the vanes at the lower stage are arranged to be tilted so that the leading portions in the rotating direction are farther downward, said upper agitating member pushing the object and the binder downward and upward, thereby applying shearing force and centrifugal force to the object.

11. An agitating pulverizer according to claim 10, wherein the other end of each of said vanes of said lower agitating member is raised along the inner surface of said tank.

12. An agitating pulverizer according to claim 10, wherein said tank comprises: a jacket for cooling and heating the inside of said tank; a charging nozzle for charging the binder therethrough; and a ventilation filter for allowing a gas within said tank to vent.

* * * * *